US008559648B2

(12) United States Patent
Christoph

(10) Patent No.: US 8,559,648 B2
(45) Date of Patent: Oct. 15, 2013

(54) ACTIVE NOISE CONTROL USING BASS MANAGEMENT

(75) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1150 days.

(21) Appl. No.: 12/240,523

(22) Filed: Sep. 29, 2008

(65) Prior Publication Data

US 2009/0086990 A1 Apr. 2, 2009

(30) Foreign Application Priority Data

Sep. 27, 2007 (EP) ..... 07019092
Jan. 30, 2008 (EP) ..... 08001742

(51) Int. Cl.
*G10K 11/175* (2006.01)
*G10K 11/178* (2006.01)
*G10K 11/16* (2006.01)

(52) U.S. Cl.
USPC ..... 381/71.12; 381/71.9; 381/71.4

(58) Field of Classification Search
USPC ..... 381/71.12, 71.11, 71.9, 71.8, 71.4, 381/71.2, 94.9, 86
See application file for complete search history.

(56) References Cited

U.S. PATENT DOCUMENTS 5,010,576 A * 4/1991 Hill ..... 381/71.9
5,170,433 A 12/1992 Elliot et al.
5,319,715 A * 6/1994 Nagami et al. ..... 381/71.14
5,321,759 A * 6/1994 Yuan ..... 381/71.9
5,337,365 A * 8/1994 Hamabe et al. ..... 381/71.12
5,410,604 A * 4/1995 Saito et al. ..... 381/71.4
5,410,605 A * 4/1995 Sawada et al. ..... 381/71.14
5,502,770 A * 3/1996 Kuo et al. ..... 381/71.9
5,526,292 A * 6/1996 Hodgson et al. ..... 700/280
5,548,652 A * 8/1996 Fujiwara et al. ..... 381/71.6
5,604,813 A * 2/1997 Evans et al. ..... 381/71.6
5,701,349 A * 12/1997 Sano et al. ..... 381/71.4
5,754,662 A * 5/1998 Jolly et al. ..... 381/71.4
5,917,919 A * 6/1999 Rosenthal ..... 381/71.11
7,352,869 B2 * 4/2008 Inoue et al. ..... 381/71.11
7,536,018 B2 * 5/2009 Onishi et al. ..... 381/71.8
7,873,173 B2 * 1/2011 Inoue et al. ..... 381/71.4
7,881,482 B2 * 2/2011 Christoph ..... 381/103
8,098,837 B2 * 1/2012 Inoue et al. ..... 381/71.4
2001/0016047 A1 8/2001 Ohta
2005/0031143 A1 2/2005 Devantier et al.
2005/0152562 A1 7/2005 Holmi et al.
2005/0207583 A1 * 9/2005 Christoph ..... 381/57
2007/0025559 A1 2/2007 Mihelich et al.
2010/0014685 A1 * 1/2010 Wurm ..... 381/71.11
2010/0195844 A1 * 8/2010 Christoph et al. ..... 381/71.11

FOREIGN PATENT DOCUMENTS

EP 1843635 10/2007
GB 2191063 12/1987

* cited by examiner

*Primary Examiner* — Edgardo San Martin
(74) *Attorney, Agent, or Firm* — O'Shea Getz P.C.

(57) ABSTRACT

An active noise cancellation system reduces, at a listening position, the power of a noise signal being radiated from a noise source to the listening position. The system includes an adaptive filter that receives a reference signal representing the noise signal, and provides a compensation signal. A bass management unit receives the compensation signal and applies a phase shift to the compensation signal to provide a phase shifted compensation signal. A first acoustic radiator receives the phase shifted compensation signal and radiates audio indicative thereof to the listening position. A second acoustic radiator receives the compensation signal and radiates audio indicative thereof to the listening position. The transfer function characteristics from the input of the bass management system to the listening position approximately matches a desired transfer function.

18 Claims, 14 Drawing Sheets

ACTIVE NOISE CONTROL USING BASS MANAGEMENT

CROSS REFERENCE TO RELATED APPLICATIONS

This application contains subject matter related to commonly assigned application Ser. No. 12/240,464, entitled "Automatic Bass Management" filed even-date herewith via EFS-web. This application is hereby incorporated by reference.

CLAIM OF PRIORITY

This patent application claims priority to European Patent Application serial number 07 019 092.1 filed on Sep. 27, 2007 and European Patent Application serial number 08 001 742.9 filed on Jan. 30, 2008.

FIELD OF THE INVENTION

The present invention relates to active noise control and to a bass management system for equalizing the sound pressure level in the low frequency (bass) range in order to approach a desired sound pressure level target function.

RELATED ART

Disturbing Noise, in contrast to a useful sound signal, is sound that is not intended to meet a certain receiver (e.g., a listener's ears). Generally the process of generating noise and disturbing sound signals can be divided into three sub-processes. These are the generation of noise by a noise source, the transmission of the noise away from the noise source and the radiation of the noise signal. Suppression of noise may take place directly at the noise source, for example by damping. Suppression may also be achieved by inhibiting or damping transmission and/or radiation of noise. However, in many applications these efforts do not yield the desired effect of reducing the noise level in a listening room below an acceptable limit. Additionally or alternatively, noise control methods and systems may be employed that eliminate or at least reduce the noise radiated into a listening room by destructive interference, that is, by superposing the noise signal with a compensation signal. Such systems and methods are summarized under the term "active noise control" (ANC).

Although it is known that points of silence can be achieved in a listening room by superposing a compensation sound signal and the noise signal to be suppressed, such that they destructively interfere. However, a reasonable technical implementation has not been feasible until the development of high performance digital signal processors.

Today's systems for actively suppressing or reducing the noise level in a listening room (known as "active noise control" systems) generate a compensation sound signal of the same amplitude and the same frequency components as the noise signal to be suppressed, but with a phase shift of 180° with respect to the noise signal. The compensation sound signal interferes destructively with the noise signal and thus the noise signal is eliminated or damped at least at certain positions within the listening room.

In the case of a motor vehicle the term "noise" covers, for example, noise generated by mechanical vibrations of the engine or fans and components mechanically coupled thereto, noise generated by the wind when driving, or the tire noise. Modern motor vehicles may comprise features such as a so-called "rear seat entertainment" that provides high-fidelity audio presentation using a plurality of loudspeakers arranged within the passenger compartment of the motor vehicle. In order to improve quality of sound reproduction disturbing noise has to be considered in digital audio processing. Another goal of active noise control is to facilitate conversations between persons sitting on the rear seats and on the front seats.

Modern active noise control systems depend on digital signal processing and digital filter techniques. Typically a noise sensor, that is, for example, a microphone or a non-acoustic sensor, is employed to obtain an electrical reference signal representing the disturbing noise signal generated by a noise source. This signal is fed to an adaptive filter and the filtered reference signal is then supplied to an acoustic actuator (e.g., a loudspeaker) that generates a compensation sound field that is in phase opposition to the noise within a defined area of the listening room thus eliminating or at least damping the noise within a defined portion of the listening room. The residual noise signal may be measured by a microphone. The resulting microphone output signal may be used as an "error signal" that is fed back to the adaptive filter, where the filter coefficients of the adaptive filter are modified such that the power of the error signal is minimized.

An algorithm that is commonly used for such minimization tasks is the so-called "Filtered-x-LMS" (FXLMS) algorithm, which is based on the well known "least mean squares" (LMS) algorithm. For implementing the algorithm a model of the transfer characteristic from the acoustic actuator generating the compensation sound signal (e.g., a loudspeaker) to the microphone measuring the residual noise has to be provided. This transfer characteristic is commonly denoted as "secondary path" transfer function, whereas the transfer characteristics from the noise source to the microphone is denoted as "primary path" transfer function. However, the secondary path transfer function is generally unknown and has to be a-priori estimated from measurements. The estimated secondary path transfer function is then used in the FXLMS algorithm.

However, the "shape" of the absolute value of the secondary path transfer function over frequency (i.e., its frequency response) has an essential impact on the convergence and the stability properties of an FXLMS algorithm and thus on the quality and on the speed of adaptation of the active noise control (ANC) system. In a typical acoustic environment of a car (e.g., the passenger compartment) the frequency response of the secondary path transfer function varies significantly over frequency thus degrading the performance (i.e., precision and speed) of the adaptation process that uses the FXLMS algorithm.

There is a general need for an enhanced active noise control system based on an FXLMS adaptive filters being improved in terms of adaptation precision and adaptation speed.

SUMMARY OF THE INVENTION

According to an aspect of the invention, an active noise cancellation system reduces, at a listening position, the power of a noise signal being radiated from a noise source to the listening position. The system includes an adaptive filter that receives a reference signal representing the noise signal, and provides a compensation signal. A bass management unit receives the compensation signal and applies a phase shift to the compensation signal to provide a phase shifted compensation signal. A first acoustic radiator receives the phase shifted compensation signal and radiates audio indicative thereof to the listening position. A second acoustic radiator receives the compensation signal and radiates audio indicative thereof to the listening position. The transfer function characteristics from the input of the bass management system to the listening position approximately matches a desired transfer function.

Another example of the invention relates to a method for reducing, at a listening position, the power of a noise signal being radiated from a noise source to the listening position, the method comprising: providing a reference signal representing the noise signal; adaptive filtering the reference signal thus providing a compensation signal; supplying the compensation signal to at least two acoustic transducers via a bass management system for radiating the compensation signal or filtered versions thereof, where the bass management system distributes the compensation signal to the acoustic transducers and filters the compensation signal for at least a first acoustic transducer by a phase filter such that the transfer characteristic from the input of the bass management system to the listening position approximately matches a desired transfer function.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Active noise control systems may either be implemented as feed-forward structures or as feed-back structures. In a feed-forward structure the acoustic actuator, which generally is a loudspeaker or a set of loudspeakers, is supplied with a signal correlated with the disturbing noise signal that is to be suppressed. In contrast, in a feed-back structure the respective error signal is fed back to the loudspeaker. Feed-forward structures may be preferred for active noise control because they are easier to handle than feedback systems. The following discussion considers mainly ANC systems with a feed-forward structure, however the present invention is also applicable to active noise control systems realized in a feed-back structure. Furthermore, in the figures all signals are regarded as digital signals. Analog-to-digital and digital-to-analog converters as well as amplifiers which are necessary in practice, for example, for sensor signal amplification, are not depicted in the following figures for the sake of simplicity and clarity.

Figure 1:
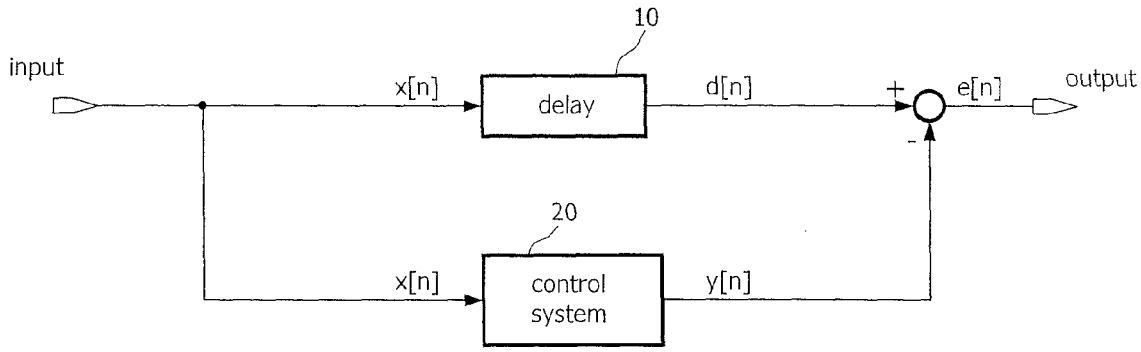
FIG. 1 is a block diagram of a basic feed-forward structure.

FIG. 1 illustrates the signal flow in a basic feed-forward structure. An input signal x[n], for example, the disturbing noise signal or a signal derived therefrom and correlated thereto, is supplied to a primary path system 10 and a control system 20. The primary path system 10 may impose a delay to the input signal x[n], for example, due to the propagation of the disturbing noise from the noise source to that portion of the listening room (i.e., the listening position) where a suppression of the noise signal should be achieved (i.e., to the desired "point of silence"). The delayed input signal is denoted as d[n]. In the control system 20 the noise signal x[n] is filtered such that the filtered input signal (denoted as y[n]), when superposed with the delayed input signal d[n], compensates for the noise due to destructive interference in the considered portion of the listening room. The output signal of the feed-forward structure of FIG. 1 is an error signal e[n] which is a residual signal comprising the signal components of the delayed input signal d[n] that were not suppressed by the superposition with the filtered input signal y[n]. The signal power of the error signal e[k] may be regarded as a quality measure for the noise cancellation achieved.

In practice the control system 20 is implemented as an adaptive filter since the signal level and the spectral composition of the noise to be suppressed may vary over time. For example, when using an ANC system in a motor vehicle an adaptive filter may thus adapt to changes of environmental conditions, for example, different road surfaces, an open window, different load of the engine, et cetera.

An unknown system may be estimated by an adaptive filter. The filter coefficients of the adaptive filter are modified such that the transfer characteristic of the adaptive filter approximately matches the transfer characteristic of the unknown system. In ANC applications digital filters are used as adaptive filters, for examples finite impulse response (FIR) or infinite impulse response (IIR) filters whose filter coefficients are modified according to a adaptation algorithm.

The adaptation of the filter coefficients is a recursive process that optimizes the filter characteristic of the adaptive filter by reducing, ideally eliminating, an error signal that is essentially the difference between the output of the unknown system and the adaptive filter, where both are supplied with the same input signal. If a norm of the error signal approaches zero, the transfer characteristic of the adaptive filter approaches the transfer characteristic of the unknown system. In ANC applications the unknown system may thereby represent the path of the noise signal from the noise source to the spot where noise suppression is to be achieved (primary path). The noise signal is thereby "filtered" by the transfer characteristic of the signal path which, in case of a motor vehicle, comprises the passenger compartment (primary path transfer function).

Figure 2:
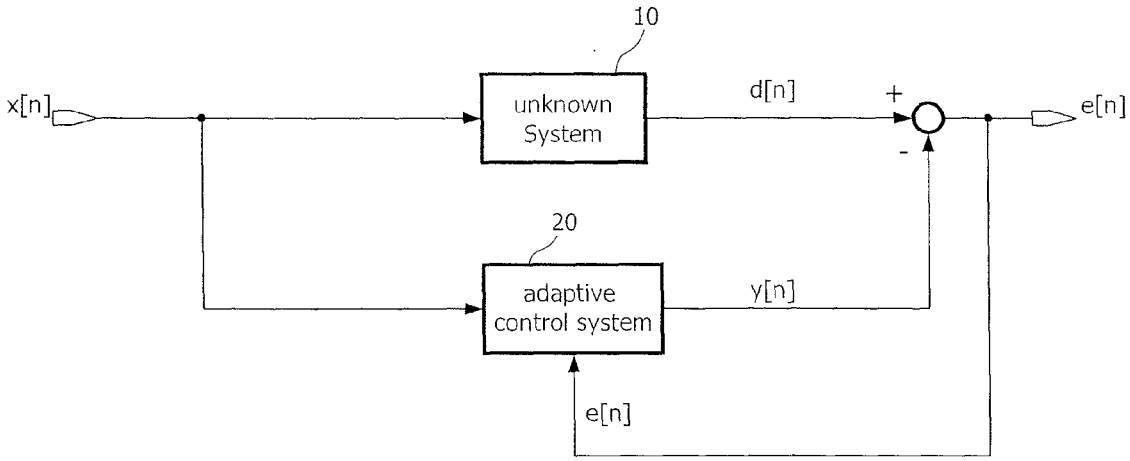
FIG. 2 illustrates a basic adaptive filter structure and signal flow for system identification.

FIG. 2 illustrates the estimation of the unknown system 10 by an adaptive filter 20. The input signal x[n] is supplied to the unknown system 10 and to the adaptive filter 20. The output signal of the unknown system d[n] and the output signal y[n] of the adaptive filter are destructively superposed (i.e., subtracted) and the residual signal, that is, the error signal e[n] is fed back to the adaptive filter 20. A least mean square (LMS) algorithm may, for example, be employed within the adaptive filter 20 for calculating modified filter coefficients such that the norm of the error signal e[n] becomes minimal. In this case an optimal suppression of the output signal d[n] of the unknown system 10 is achieved.

The adaptation algorithm operates recursively. That is, in each clock cycle of the ANC system a new set of optimal filter coefficients is calculated. The LMS algorithm has low complexity, it is numerical stable and has low memory requirements. However, one of ordinary skill with recognize that many other algorithms may also be applicable for minimizing the error signal e[k].

A modification of the LMS algorithm that is commonly used in active noise control applications is the so-called "filtered-x LMS" (FXLMS) algorithm. Further explanation will proceed on the basis of a modified feed-forward structure comprising an adaptive filter and an adaptation unit for calculating the filter coefficients for the adaptive filter thereby using a FXLMS algorithm. A respective block diagram is depicted in FIG. 3.

Figure 3:
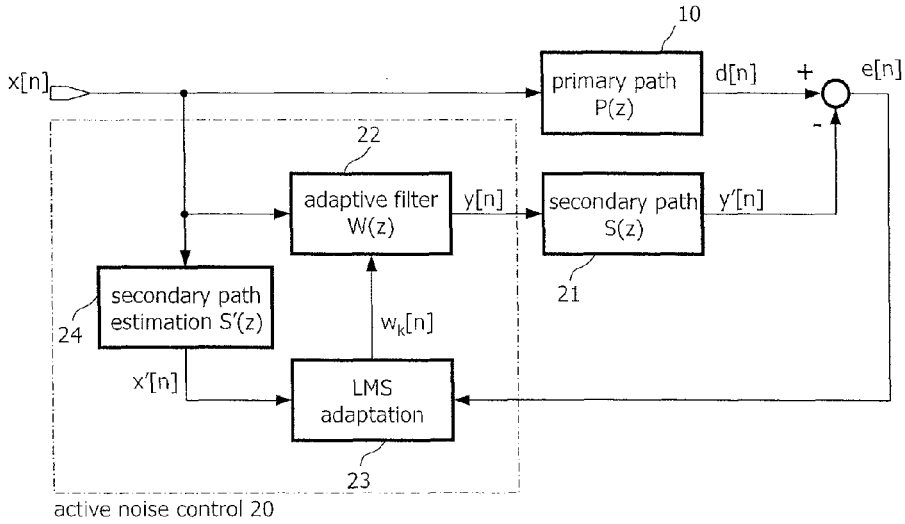
FIG. 3 illustrates the structure and signal flow of an active noise control system with an adaptive filter using the filtered-x algorithm for adaptation.

The model of the ANC system 20 of FIG. 3 comprises the primary path system 10 with a transfer function P(z) representing the transfer characteristics of the signal path between the noise source and the portion of the listening room where the noise is to be suppressed. The ANC system 20 includes an adaptive filter 22 having a filter transfer function W(z) and an adaptation unit 23 for calculating an optimal set of filter coefficients $w_k=(w_0, w_1, w_2, \ldots)$ for the adaptive filter 22. A secondary path system 21 with a transfer function S(z) is arranged downstream of the adaptive filter 22 and represents the signal path from the loudspeaker radiating the compensation signal provided by the adaptive filter 22 to the portion of the listening room where the noise is to be suppressed. When using the FXLMS algorithm for the calculation of the optimal filter coefficients an estimation S'(z) (system 24) of the secondary path transfer function S(z) is required. The primary path system 10 and the secondary path system 21 are "real" systems representing the physical properties of the listening room, where the other transfer functions are implemented in a digital signal processor.

The input signal x[n] represents the noise signal generated by a noise source. It is measured, for example, by a non-acoustic sensor and supplied to the primary path system 10 which provides the output signal d[n]. The input signal x[n] is also supplied to the adaptive filter 22 which provides the filtered signal y[n]. The filtered signal y[n] is supplied to the secondary path system 21 which provides a modified filtered signal y'[n] that destructively superposes with the output signal d[n] of the primary path system 10. Therefore, the adaptive filter has to impose an additional 180 degree phase shift to the signal path. The "result" of the superposition is a measurable residual signal that is used as an error signal e[n] for the adaptation unit 23. For calculating updated filter coefficients $w_k$ an estimated model of the secondary path transfer function S(z) is required. The estimated secondary path transfer function S'(z) 24 also receives the input signal x[n] and provides a modified input signal x'[n] to the adaptation unit 23.

The function of the algorithm is summarized below: due to the adaptation process the transfer function W(z)-S(z) of the series connection of the adaptive filter W(z) and the secondary path S(z) approaches the primary path transfer function P(z), where an additional 180° phase shift is imposed to the signal path of the adaptive filter 22 and thus the output signal d[n] of the primary path 10 and the output signal y'[n] of the secondary path 21 superpose destructively thereby suppressing the effect of the input signal x[n] in the considered portion of the listening room. The residual error signal e[n] may be measured by a microphone and is supplied to the adaptation unit 23 as well as the modified input signal x'[n] provided by the estimated secondary path transfer function S'(z). The adaptation unit 23 is configured to calculate the filter coefficients $w_k$ of the adaptive filter W(z) from the modified input signal x'[n] ("filtered x") and the error signal e[k], such that a norm of the error signal |e[k]| becomes minimal. For this purpose, an LMS algorithm may be a good choice as already discussed above. The circuit blocks 22, 23, and 24 together form the active noise control unit 20 which may be implemented in a digital signal processor. Of course alternatives or modifications of the "filtered-x LMS" algorithm, such as, for example, the "filtered-e LMS" algorithm, are applicable. Examples for the application of the filtered-x LMS algorithm and the filtered-e LMS algorithm are described with reference to FIG. 4A and FIG. 4B, respectively.

Figure 4A:
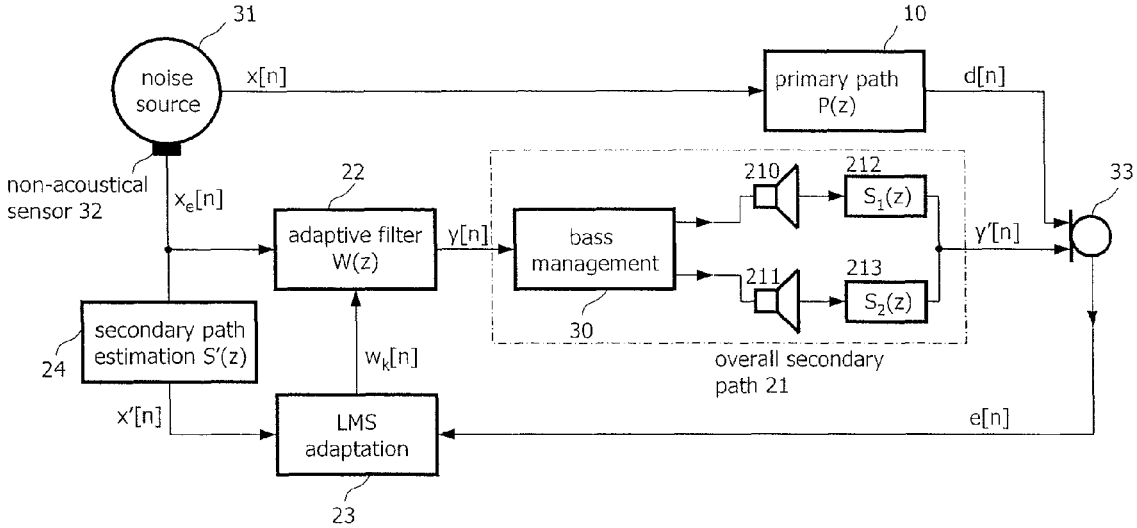
FIGS. 4A-4C are block diagram illustrations of active noise control systems with adaptive filtering, and a bass management system in series to its secondary path.

FIG. 4A illustrates as one example of a system for active noise control according to the structure of FIG. 3, where a bass management system (BMS) 30 is arranged between the adaptive filter 22 and the secondary path system. A noise source 31 generates the input noise signal x[n] for the ANC system and a microphone 33 senses the residual error signal e[n]. The noise signal generated by the noise source 31 provides the input signal x[n] to the primary path. The output signal d[n] of the primary path system 10 represents the noise signal to be suppressed. An electrical representation $x_e[n]$ of the input signal x[n] may be provided by a non-acoustical sensor 32, for example an acceleration sensor. The electrical representation $x_e[n]$ of the input signal x[n], that is the sensor signal, is supplied to the adaptive filter 22. The filtered signal y[n] is supplied to the secondary path 21 by the bass management system 30. The output signal of the secondary path 21 is a compensation signal destructively interfering with the noise filtered by the primary path 10. The residual signal is measured with the microphone 33 whose output signal is supplied to the adaptation unit 23 as error signal e[n]. The adaptation unit calculates optimal filter coefficients $w_k$ for the adaptive filter 22.

Figure 4B:
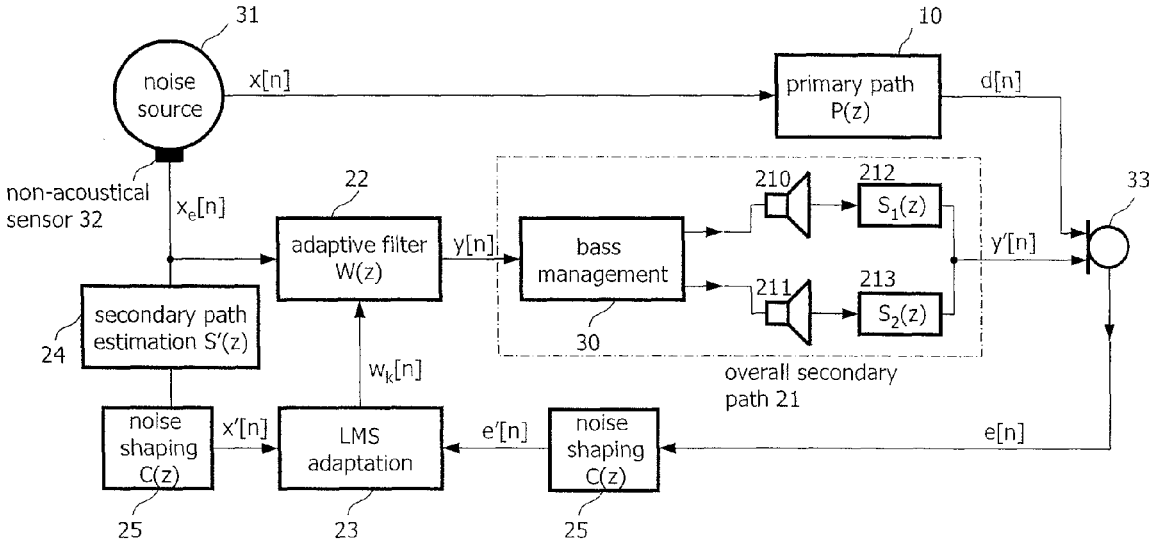

The example illustrated in FIG. 4B is similar to the example of FIG. 4A. In some applications it may be desirable to shape the spectrum of the residual error signal e[n]. The spectrum of the error signal e[n] is determined by the transfer function C(z) of the noise shaping unit 25 that is arranged upstream of the adaptation unit 23. Due to the filtering of the residual error signal e[n] before applying the LMS algorithm, the overall algorithm is denoted as filtered-e LMS algorithm (short FELMS algorithm).

Figure 4C:
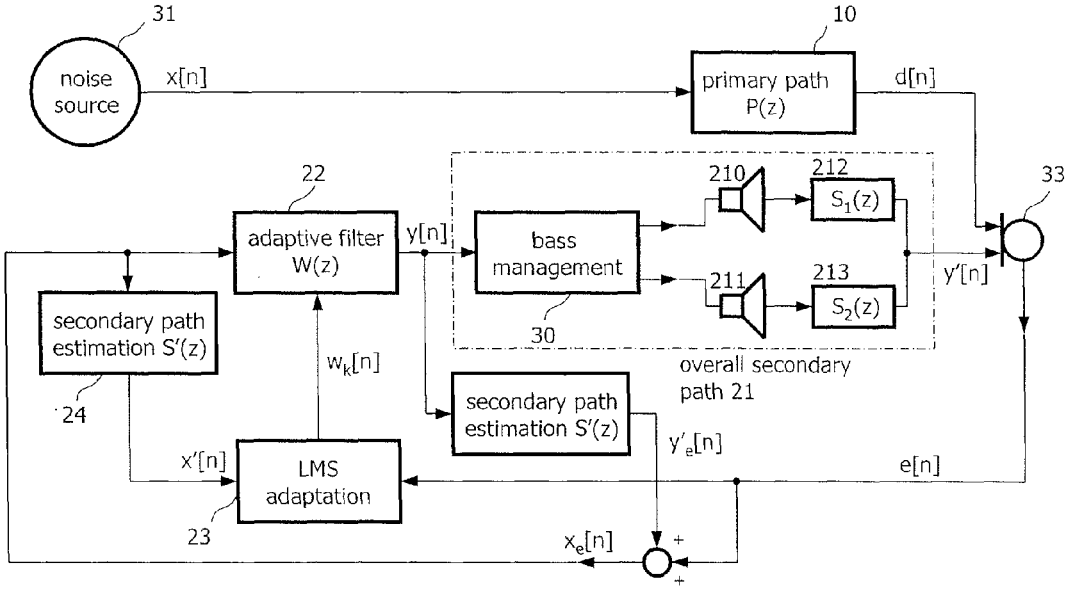

FIG. 4C illustrates a feed-back ANC system, which is similar to the feed-forward system of FIG. 4A. Corresponding components of the present feed-back ANC system and the feed-forward system of FIG. 4A are denoted with the same reference symbols. A difference between the two systems of FIG. 4A and FIG. 4C is the way the electrical representation $x_e[n]$ of the input signal x[n], which is generated by the noise source 31, is obtained. In contrast to the feed-forward system where the signal $x_e[n]$ is generated, for example, by the non-acoustical sensor 32, the signal $x_e[n]$ is estimated from the compensation signal y[n] and the error signal e[n] received by the microphone 33. For the estimation the estimated secondary path transfer function S'(z) is used to calculate an estimated output signal $y'_e[n]$ of the secondary path 21. The signal $x_e[n]$ is then determined by an adder 31, which adds the estimated output signal $y'_e[n]$ and the measured error signal e[n]. The signal $x_e[n]$ represents the input signal x[n] (noise signal of noise source 31) and is processed in the same way as in the feed-forward ANC system of FIG. 4A.

For feed-forward ANC systems (e.g., FIGS. 4A and 4B) as well as for feed-back ANC systems (e.g., FIG. 4C) the estimation S'(z) of the secondary path transfer function S(z) has to be a-priori known. However, this is also valid for many other ANC systems based on the basic feed-forward or feed-back structures or combinations thereof. As already explained above the quality of the estimation S'(z) of the secondary path transfer function S(z) is critical for the performance of the FXLMS and FELMS algorithms used for adaptation of the filter coefficients $w_k$. Furthermore, a "flat" shape of the frequency response of the secondary path transfer function S(z) would be desirable for optimal performance of the adaptation algorithm which is usually not the case. Especially in small listening rooms such as the passenger compartment of a car, the amplitude of the frequency response substantially varies over frequency. According to an aspect of the invention the bass management system 30 is used to modify the transfer function S(z) of the secondary path to match (at least approximately) a desired target function. In order to boost performance of the ANC system the target function may be chosen to be flat, that is, without notches.

The bass management system 30 requires that the secondary path system comprises at least two loudspeakers 210, 211 to adjust the secondary path transfer function S(z) in order to match the desired target function. The transfer characteristic from the first loudspeaker 210 to the microphone 33 is denoted as transfer function $S_1(z)$, while the transfer characteristic from the second loudspeaker 211 to the microphone 33 as transfer function $S_2(z)$. The transfer functions $S_1(z)$ and $S_2(z)$ describe the loudspeaker-room-microphone (LRM) systems that together form the overall secondary path 21. The overall secondary path transfer function S(z) is calculated as the sum of the single transfer functions, that is $S(z)=S_1(z)+S_2(z)$ for the case of two loudspeakers. Of course three or more loudspeakers may be used with the bass management system.

Figure 5:
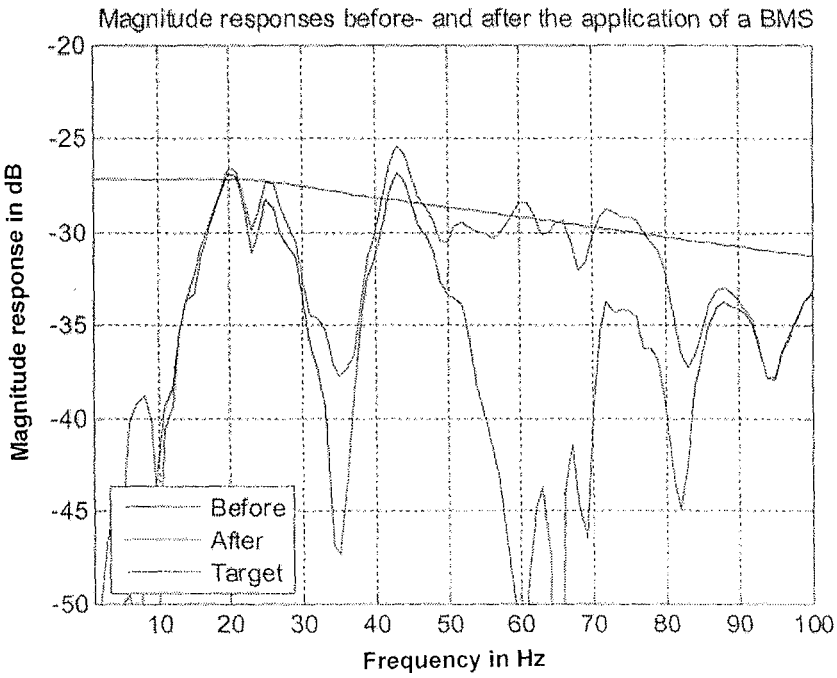
FIG. 5 illustrates the equalization of the secondary path transfer function of the active noise control system of FIG. 4A or FIG. 4B by the bass management system.

The two loudspeakers 210, 211 receive the same signal y[n] from the adaptive filter 22 where the bass management system 30 comprises a phase filter arranged upstream to at least one of the loudspeakers. The phase filter imposes a frequency dependent phase shift to the signal received by the first loudspeaker with respect to the signal received by the second loudspeaker. The phase shift is chosen such that the overall transfer function $S(z)=S_1(z)+S_2(z)$ matches a desired target function. The effect is illustrated in FIG. 5. Variations of the magnitude response of over 20 dB are dramatically reduced for frequencies above 40 Hz. The improved magnitude response "oscillates" around the desired target function.

The further description is dedicated to the bass management system. Up to now it is usual practice to acoustically optimize dedicated systems, for example in motor vehicles, by hand. Although there have been major efforts to automate this manual process, efforts have shown weaknesses in practice or are extremely complex and costly. In small, highly reflective areas, such as the interior of a car, poor improvements in the acoustics are achieved. In some cases, the results are even worse.

Especially in the frequency range below approximately 100 Hertz standing waves in the interior of small highly reflective rooms can cause strongly different sound pressure levels (SPL) in different listening locations that are, for example, the two front passenger's seats and the two rear passenger's seats in a motor vehicle. These different sound pressure levels entail the audio perception of a person being dependent on his/her listening location. A bass management system allows for equalizing the sound pressure level at different listening locations as well as for "forming" the frequency response of the sound pressure level at one or more listening locations in order to math a desired target function.

Figure 6:
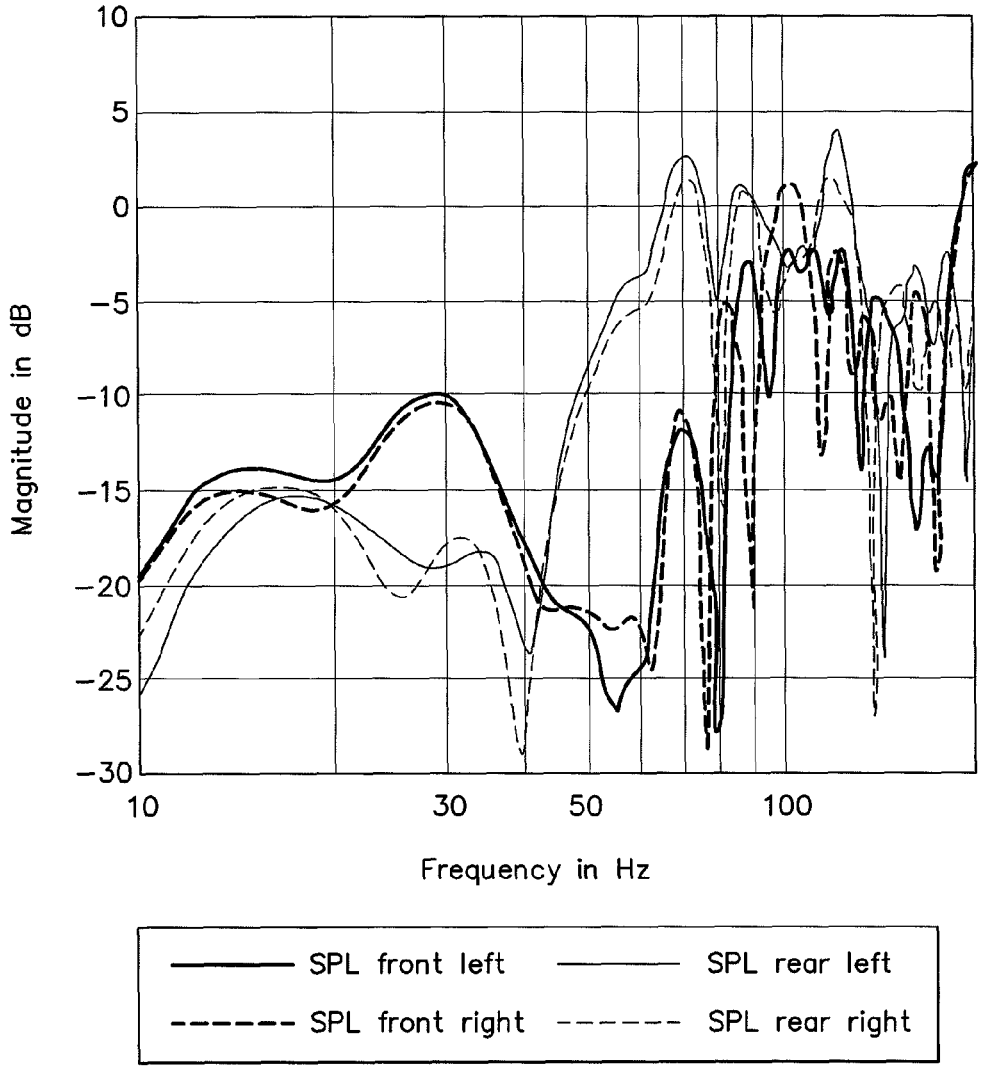
FIG. 6 is a diagram illustrating the sound pressure level in decibel over frequency measured on four different listening locations within a passenger compartment of a car with an unmodified audio signal being supplied to the loudspeakers.

While reproducing an audio signal by a loudspeaker or a set of loudspeakers in a car, measurements in the passenger compartment of the car yield considerably different results for the sound pressure level (SPL) observed at different listening locations even where the loudspeakers are symmetrically arranged within the car. The diagram of FIG. 6 illustrates this effect. In the diagram four curves are depicted, each illustrating the sound pressure level in decibel (dB) over frequency which have been measured at four different listening locations in the passenger compartment, namely near the head restraints of the two front and the two rear passenger seats, while supplying an audio signal to the loudspeakers. The sound pressure level measured at listening locations in the front of the room and the sound pressure level measured at listening locations in the rear differ by up to 15 dB dependent on the considered frequency. However, the biggest gap between the SPL curves can be typically observed within a frequency range from approximately 40 to 90 Hertz which is part of the bass frequency range.

"Bass frequency range" is not a well-defined term but is widely used in acoustics for low frequencies in the range from, for example, 0 to 80 Hertz, 0 to 120 Hertz or even 0 to 150 Hertz. When using car sound systems with a subwoofer placed in the rear window shelf or in the rear trunk, an undesirable distribution of sound pressure level within the listening room may be observed. The SPL maximum between 60 and 70 Hertz (see FIG. 6) may be regarded as booming and unpleasant by rear passengers.

Figure 7:
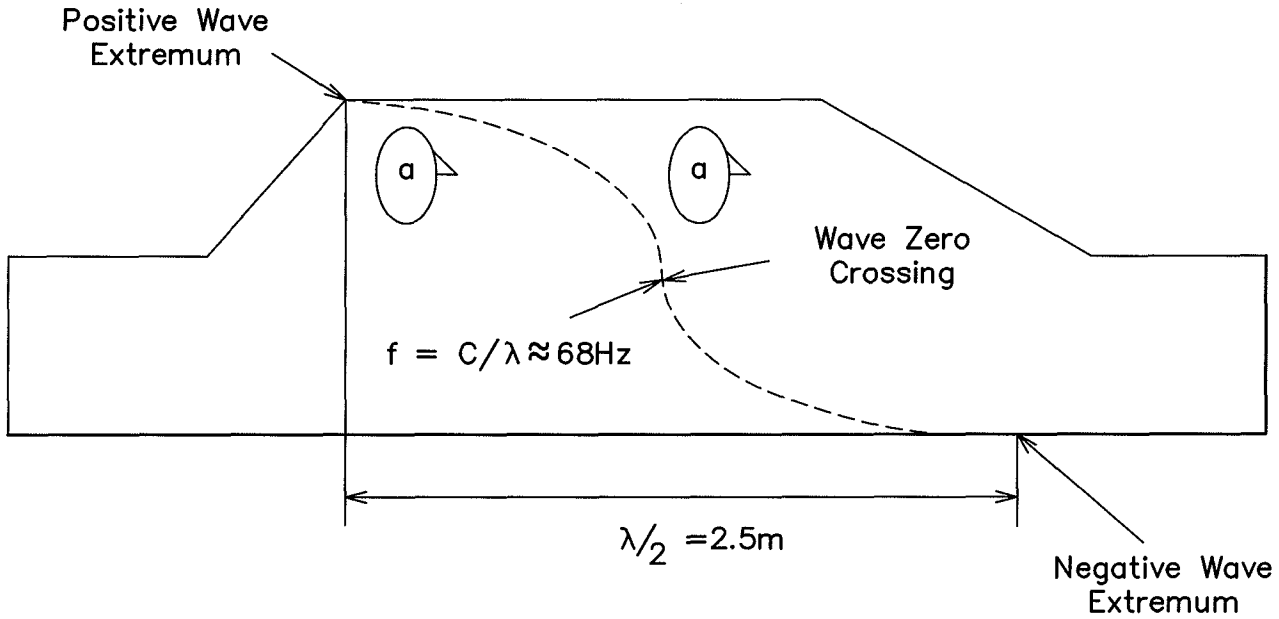
FIG. 7 illustrates standing acoustic waves in the passenger compartment of a car effecting large differences in sound pressure level (SPL) between the listening locations.

The frequency range, where a big discrepancy between the sound pressure levels in different listening locations, especially between locations in the front and in the rear of the car, can be observed, depends on the dimensions of the listening room. The reason for this will be explained with reference to FIG. 7 which is a schematic side-view of a car. A half wavelength (denoted as $\lambda/2$) fits lengthwise in the passenger compartment. A typical length of $\lambda/2=2.5$ m yields a frequency of $f=c/\lambda=68$ Hz when assuming a speed of sound of c=340 m/s. FIG. 6 illustrates that at approximately $f=c/\lambda=68$ Hz a maximum SPL can be observed at the rear listening locations. Therefore it can be concluded that superpositions of several standing waves in longitudinal and in lateral direction in the interior of the car (the listening room) are responsible for the inhomogeneous SPL distribution in the listening room.

In order to achieve more similar, in the best case equal, SPL curves (magnitude over frequency) at a given set of listening locations within the listening room, a technique for an automatic equalization of the sound pressure level is described below by way of examples. For the following discussion it is assumed that only two loudspeakers are arranged in a listening room (e.g., a passenger compartment of a car) where four different listening locations are of interest, namely a front left (FL), a front right (FR) a rear left (RL) and a rear right (RR) positions. Of course the number of loudspeakers and listening positions is not limited. The technique may be generalized to an arbitrary number of loudspeakers and listening locations.

Both loudspeakers are supplied with the same audio signal of a defined frequency f, such that both loudspeakers contribute to the generation of the respective sound pressure level in each listening location. The audio signal is provided by a signal source (e.g., an amplifier) having an output channel for each loudspeaker to be connected. At least the output channel supplying the second one of the loudspeakers is configured to apply a programmable phase shift $\phi$ to the audio signal supplied to the second loudspeaker.

Figure 8:
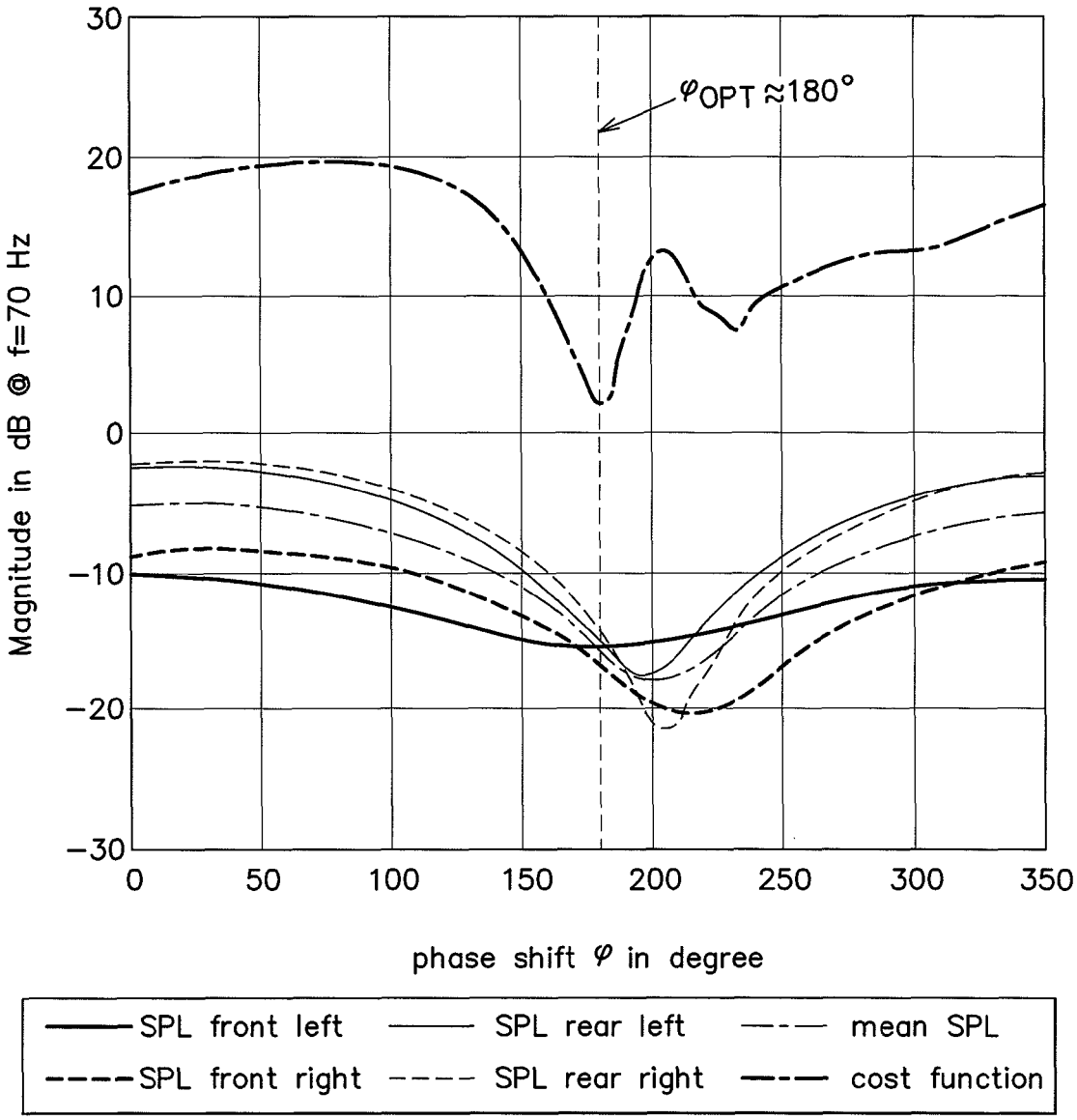
FIG. 8 is a diagram illustrating the sound pressure level in decibel over phase shift; a minimum distance between the sound pressure levels at the listening locations and a reference sound pressure level is found at the minimum of a cost function representing the distance.

The sound pressure level observed at the listening locations of interest will change dependent on the phase shift applied to the audio signal that is fed to the second loudspeaker while the first loudspeaker receives the same audio signal with no phase shift applied to it. The dependency of sound pressure level SPL in decibels (dB) on phase shift $\phi$ in degrees (°) at a given frequency (in this example 70 Hz) is illustrated in FIG. 8 as well as the mean level of the four sound pressure levels measured at the four different listening locations.

A cost function CF($\phi$) is provided which represents the "distance" between the four sound pressure levels and a reference sound pressure level $SPL_{REF}(\phi)$ at a given frequency. The cost function may be defined as:

$$CF(\phi)=|SPL_{FL}(\phi)-SPL_{REF}(\phi)|+|SPL_{FR}(\phi)-SPL_{REF}(\phi)|+|SPL_{RL}(\phi)-SPL_{REF}(\phi)|+|SPL_{RR}(\phi)-SPL_{REF}(\phi)|, \quad \text{(EQ. 1)}$$

where the symbols $SPL_{FL}$, $SPL_{FR}$, $SPL_{RL}$, $SPL_{RR}$ denote the sound pressure levels at the front left, the front right, the rear left and the rear right positions respectively. The symbol $\phi$ in parentheses indicate that each sound pressure level is a function of the phase shift $\phi$. The distance between the actually measured sound pressure level and the reference sound pressure level is a measure of quality of equalization, that is, the lower the distance, the better the actual sound pressure level approximates the reference sound pressure level. In the case that only one listening location is considered, the distance may be calculated as the absolute difference between the measured sound pressure level and the reference sound pressure level, which may theoretically become zero.

EQ. 1 is an example for a cost function whose function value becomes smaller as the sound pressure levels $SPL_{FL}$, $SPL_{FR}$, $SPL_{RL}$, $SPL_{RR}$ approach the reference sound pressure level $SPL_{REF}$. The phase shift $\phi$ that minimizes the cost function yields an "optimum" distribution of the sound pressure level, that is, the sound pressure level measured at the four listening locations have approached the reference sound pressure level as good as possible and thus the sound pressure levels at the four different listening locations are equalized resulting in an improved room acoustics. In the example of FIG. 8, the mean sound pressure level is used as reference $SPL_{REF}$ and the optimum phase shift that minimizes the cost function CF($\phi$) has been determined to be approximately 180° (indicated by the vertical line).

The cost function may be weighted with a frequency dependent factor that is inversely proportional to the mean sound pressure level. Accordingly, the value of the cost function is weighted less at high sound pressure levels. As a result an additional maximation of the sound pressure level can be achieved. Generally the cost function may depend on the sound pressure level, and/or the above-mentioned distance and/or a maximum sound pressure level.

In the above example, the optimal phase shift has been determined to be approximately 180° at a frequency of the audio signal of 70 Hz. Of course the optimal phase shift is different at different frequencies. Defining a reference sound pressure level $SPL_{REF}(\phi, f)$ for every frequency of interest allows for defining cost function CF($\phi$, f) being dependent on phase shift and frequency of the audio signal. An example of a cost function CF($\phi$, f) being a function of phase shift and frequency is illustrated as a 3D-plot in FIG. 9. The mean of the sound pressure level measured in the considered listening locations is thereby used as reference sound pressure level. However, the sound pressure level measured at a certain listening location or any mean value of sound pressure levels measured in at least two listening locations may be used. Alternatively, a predefined target function of desired sound pressure levels may be used as reference sound pressure levels. Combinations of the above examples may be useful.

Figure 9:
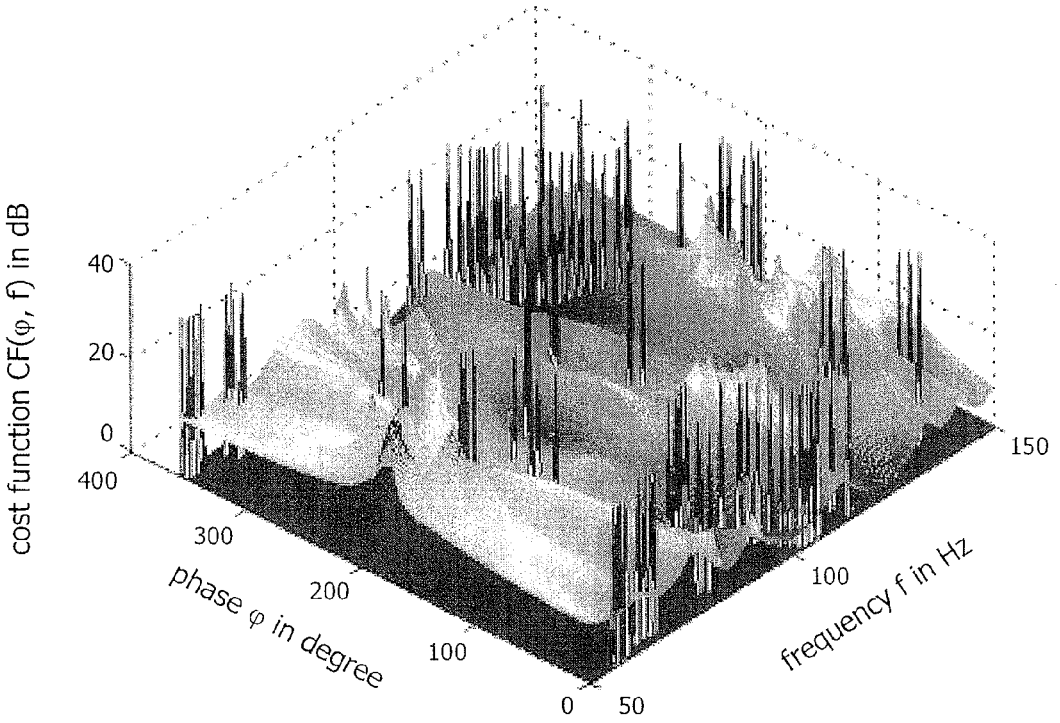
FIG. 9 is a 3D-view of the cost function over phase at different frequencies.

For each frequency f of interest, an optimum phase shift can be determined by searching the minimum of the respective cost function as explained above, thus obtaining a phase function of optimal phase shifts $\phi_{OPT}(f)$ as a function of frequency. An example of such a phase function $\phi_{OPT}(f)$ (derived from the cost function CF($\phi$, f) of FIG. 9) is depicted in FIG. 9.

The technique for obtaining a phase function $\phi_{OPT}(f)$ for optimal phase shifts in a sound system having a first and a second loudspeaker can be summarized as follows:

- Supply an audio signal of a programmable frequency f to each loudspeaker. As explained above, the second loudspeaker has a delay element connected upstream thereto configured to apply a programmable phase-shift $\phi$ to the respective audio signal.
- Measure the sound pressure level $SPL_{FL}(\phi, f)$, $SPL_{FR}(\phi, f)$, $SPL_{RL}(\phi, f)$, $SPL_{RR}(\phi, f)$ at each listening location for different phase shifts $\phi$ within a certain phase range (e.g. 0° to 360°) and for different frequencies within a certain frequency range (e.g. 0 Hz to 150 Hz).
- Calculate the value of a cost function CF($\phi$, f) for each pair of phase shift $\phi$ and frequency f, where the cost function CF($\phi$, f) is dependent on the sound pressure level $SPL_{FL}(\phi, f)$, $SPL_{FR}(\phi, f)$, $SPL_{RL}(\phi, f)$, $SPL_{RR}(\phi, f)$.
- Search, for every frequency value f for which the cost function has been calculated, the optimal phase shift $\phi_{OPT}(f)$ which minimizes the cost function CF($\phi$, f), that is $$CF(\phi_{OPT},f)=\min\{CF(\phi,f)\} \text{ for } \phi\in[0°,360°], \quad (2)$$

thus obtaining a phase function $\phi_{OPT}(f)$ representing the optimal phase shift $\phi_{OPT}(f)$ as a function of frequency.

In practice, in one example, the cost function is calculated for discrete frequencies $f=f_k\in\{f_0, f_1, \ldots, f_{K-1}\}$ and for discrete phase shifts $\phi=\phi_n\in\{\phi_0, \phi_1, \ldots, \phi_{N-1}\}$, where the frequencies may be a sequence of discrete frequencies with a fixed step-width $\Delta f$ (e.g., $\Delta f$=1 Hz) as well as the phase shifts may be a sequence of discrete phase shifts with a fixed step-width $\Delta\phi$ (e.g., $\Delta\phi$=1°). In this example, the calculated values of the cost function CF($\phi$, f) may be arranged in a matrix CF[n, k] with lines and columns, where a line index k represents the frequency $f_k$ and the column index n represents the phase shift $\phi_n$. The phase function $\phi_{OPT}(f_k)$ can then be found by searching the minimum value f or each line of the matrix. In mathematical terms:

$$\phi_{OPT}(f_k)=\phi_i \text{ for } CF[i,k]=\min\{CF[n,k]\},\ n\in\{0,\ldots N-1\},\ k\in\{0,\ldots K-1\}. \quad \text{(EQ. 3)}$$

For an optimum performance of the bass reproduction of the sound system, the optimal phase shift $\phi_{OPT}(f)$, which is to be applied to the audio signal supplied to the second loudspeaker, is different for every frequency value f. A frequency dependent phase shift may be implemented by an all-pass filter whose phase response has to be designed to match the phase function $\phi_{OPT}(f)$ of optimal phase shifts as good as possible. An all-pass filter with a phase response equal to the phase function $\phi_{OPT}(f)$ that is obtained as explained above would equalize the bass reproduction in an optimum manner. A FIR all-pass filter may be appropriate for this purpose although some trade-offs have to be accepted. In the following examples a 4096 tap FIR-filter is used for implementing the phase function $\phi_{OPT}(f)$. However, Infinite Impulse Response (IIR) filters, or all-pass filter chains, may also be used instead, as well as analog filters, which may be implemented as operational amplifier circuits.

Figure 10:
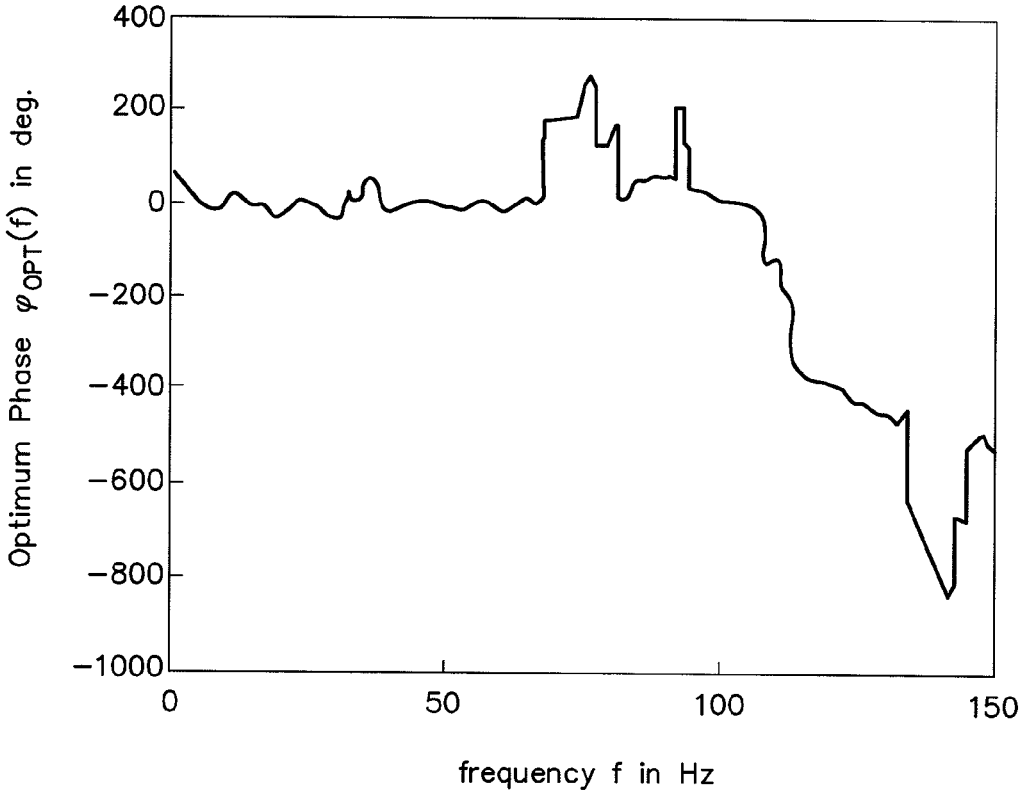
FIG. 10 is a diagram illustrating a phase function of optimum phase shifts over frequency that minimizes the cost function at each frequency value.

Looking at FIG. 10, one can see that the phase function $\phi_{OPT}(f)$ comprises many discontinuities resulting in very steep slopes $d\phi_{OPT}/df$. Such steep slopes $d\phi_{OPT}/df$ can only be implemented by FIR filters with a sufficient precision when using extremely high filter orders which is problematic in practice. Therefore, the slope of the phase function $\phi_{OPT}(f)$ is limited, for example, to ±10°. This means, that the minimum search (e.g., EQ. 3) is performed with the constraint (side condition) that the phase must not differ by more than 10° per Hz from the optimum phase determined for the previous frequency value. In mathematical terms, the minimum search is performed according EQ. 3 with the constraint $$|\phi_{OPT}(f_k)-\phi_{OPT}(f_{k-1})|/|f_k-f_{k-1}|<10°. \quad \text{(EQ. 4)}$$

In other words, in the present example the function "min" (EQ. 3) does not just mean "find the minimum" but "find the minimum for which EQ. 4 is valid". In practice the search interval where the minimum search is performed is restricted.

Figure 11:
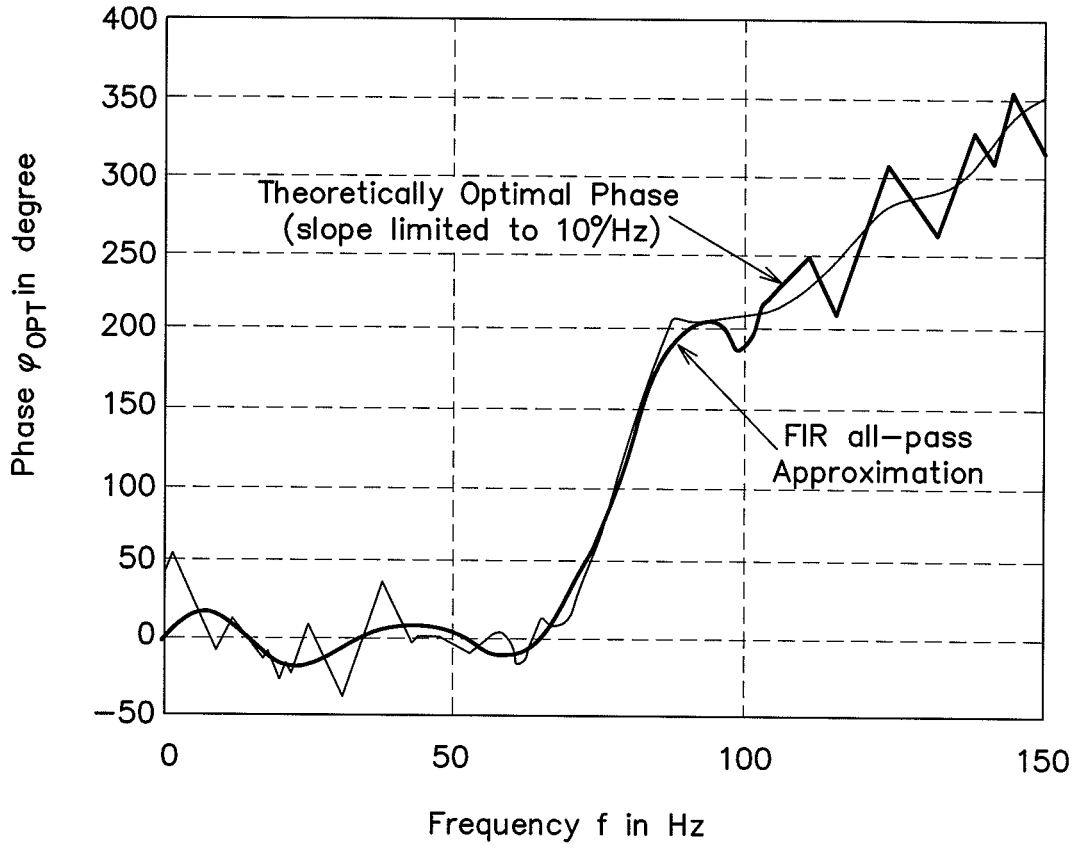
FIG. 11 is a diagram illustrating the approximation of the phase function by the phase response of a 4096 tap FIR all-pass filter.

FIG. 11 is a diagram illustrating a phase function $\phi_{OPT}(f)$ obtained according to EQ. 3 and EQ. 4 where the slope of the phase has been limited to 10°/Hz. The phase response of a 4096 tap FIR filter which approximates the phase function $\phi_{OPT}(f)$ is also depicted in FIG. 11. The approximation of the phase is regarded as sufficient in practice. The performance of the FIR all-pass filter compared to the "ideal" phase shift $\phi_{OPT}(f)$ is illustrated in FIGS. 12A to 12D.

The examples described above comprise SPL measurements in at least two listening locations. However, for some applications it may be sufficient to determine the SPL curves for only one listening location. In this example, a homogenous SPL distribution cannot be achieved, but with an appropriate cost function an optimization in view of another criterion may be achieved. For example, the achievable SPL output may be maximized and/or the frequency response, that is, the SPL curve over frequency, may be "designed" to approximately fit a given desired frequency response. Thereby the tonality of the listening room can be adjusted or "equalized" which is a common term used therefore in acoustics.

As described above, the sound pressure levels at each listening location may be actually measured at different frequencies and for various phase shifts. Alternatively, these measurements may be (fully or partially) replaced by a model calculation in order to determine the sought SPL curves by simulation. For example, in calculating sound pressure level at a defined listening location knowledge about the transfer characteristic from each loudspeaker to the respective listening location is required.

Consequently, before starting calculations, the transfer characteristic of each combination of loudspeaker and listening location has to be determined. This may be done by estimating the impulse responses (or the transfer functions in the frequency domain) of each transmission path from each loudspeaker to the considered listening location. For example, the impulse responses may be estimated from sound pressure level measurements when supplying a broad band signal sequentially to each loudspeaker. Alternatively, adaptive filters may be used. Furthermore, other known techniques for parametric and nonparametric model estimation may be employed.

After the necessary transfer characteristics have been determined, the desired SPL curves, for example the matrix visualized in FIG. 9, may be calculated. Thereby one transfer characteristic, for example an impulse response, is associated with one corresponding loudspeaker for each considered listening location. The sound pressure level is calculated at each listening location assuming for the calculation that an audio signal of a programmable frequency is supplied to each loudspeaker, where the audio signal supplied to the second loudspeaker is phase-shifted by a programmable phase shift relatively to the audio signal supplied to the first loudspeaker. Thereby, the phase shifts of the audio signals supplied to the other loudspeakers are initially zero or constant. In this context the term "assuming" has to be understood considering the mathematical context, that is, the frequency, amplitude and phase of the audio signal are used as input parameters in the model calculation.

For each listening location this calculation may be split up in the following steps where the second loudspeaker has a phase-shifting element with the programmable phase shift connected upstream thereto:

Calculate amplitude and phase of the sound pressure level generated by the first and the second loudspeaker, alternatively by all loudspeakers, at the considered listening location when supplied with an audio signal of a frequency f using the corresponding transfer characteristics (e.g., impulse responses) for the calculation, whereby the second loudspeaker is assumed to be supplied with an audio signal phase shifted by a phase shift $\phi$ respectively to the audio signal supplied to the first loudspeaker; and Superpose with proper phase relation the above calculated sound pressure levels to obtain a total sound pressure level at the considered listening location as a function of frequency f and phase shift $\phi$.

The effect of the phase shift may be subsequently determined for each further loudspeaker. Once having calculated the SPL curves for the relevant phase and frequency values, the optimal phase shift for each considered loudspeaker may be determined as described above.

Figure 12A:
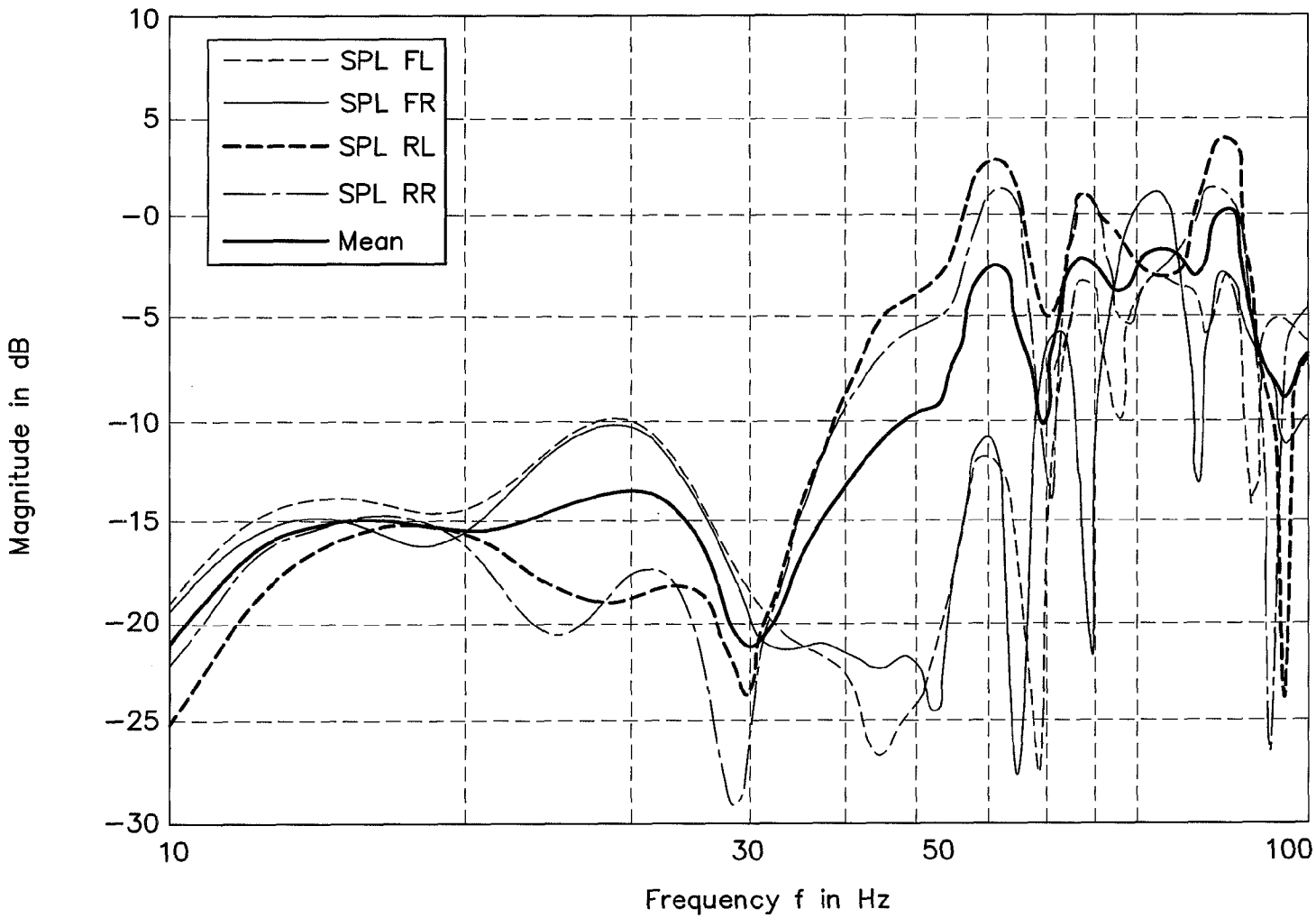
FIGS. 12A-12D are diagrams illustrating the performance of the FIR all-pass filter of FIG. 10 and the effect on the sound pressure levels at the different listening locations.

The SPL curves depicted in the diagrams of FIGS. 12A-12D have been obtained by simulation to demonstrate the effectiveness of the technique described above. FIG. 12A illustrates the sound pressure levels $SPL_{FL}$, $SPL_{FR}$, $SPLR_{RL}$, $SPL_{RR}$ measured at the four listening locations before equalization, that is, without any phase modifications applied to the audio signal. The thick black solid line represents the mean of the four SPL curves. The mean SPL has also been used as reference sound pressure level $SPL_{REF}$ for equalization. In FIG. 6, a big discrepancy between the SPL curves is observable, especially in the frequency range from 40 to 90 Hz.

Figure 12B:
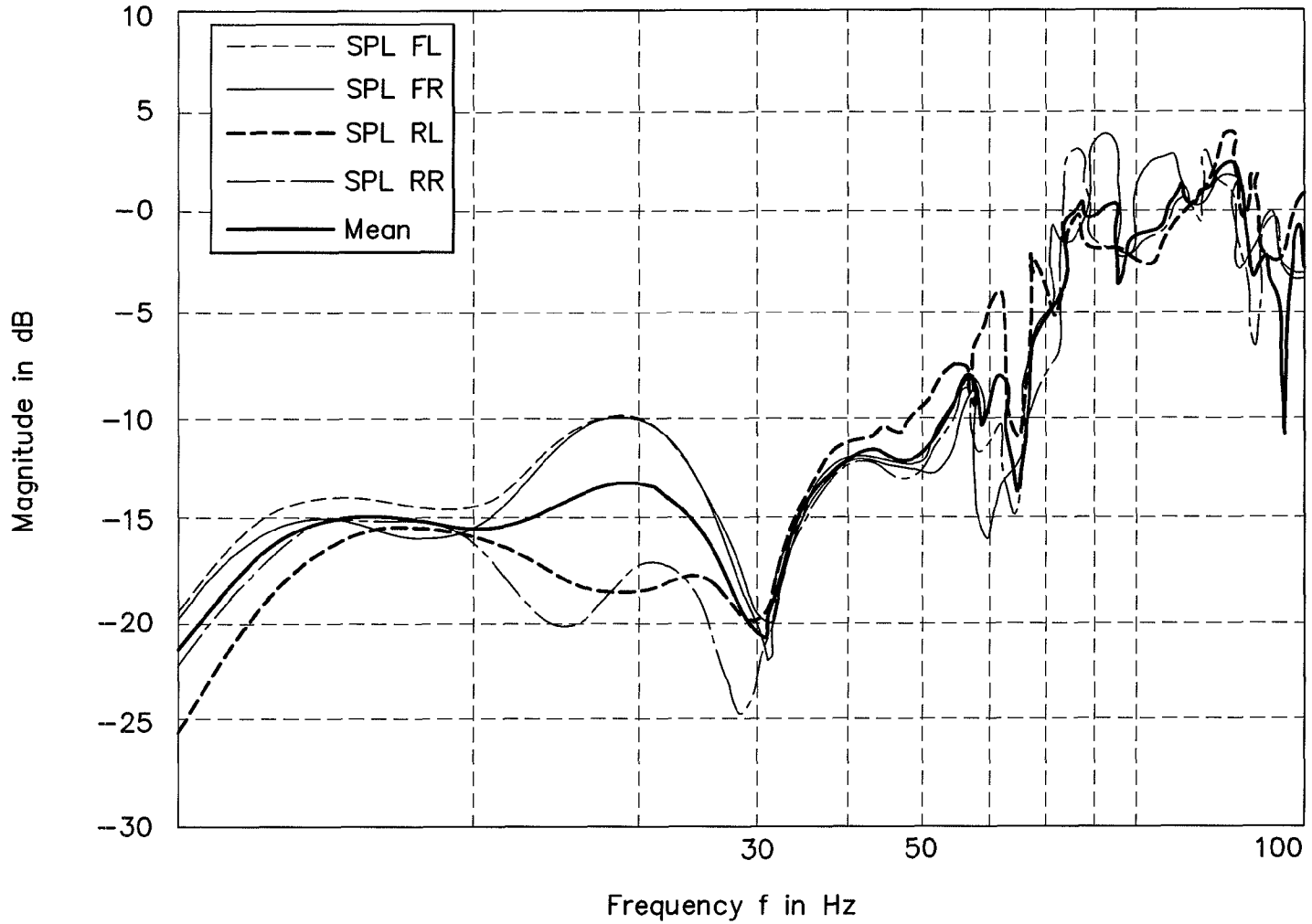

FIG. 12B illustrates the sound pressure levels $SPL_{FL}$, $SPL_{FR}$, $SPL_{RL}$, $SPL_{RR}$ measured at the four listening locations after equalization using the optimal phase function $\phi_{OPT}$ (f) of FIG. 10 (without limiting the slope $\phi_{OPT}/df$). Here the SPL curves are more similar (i.e., equalized) and deviate little from the mean sound pressure level (thick black solid line).

Figure 12C:
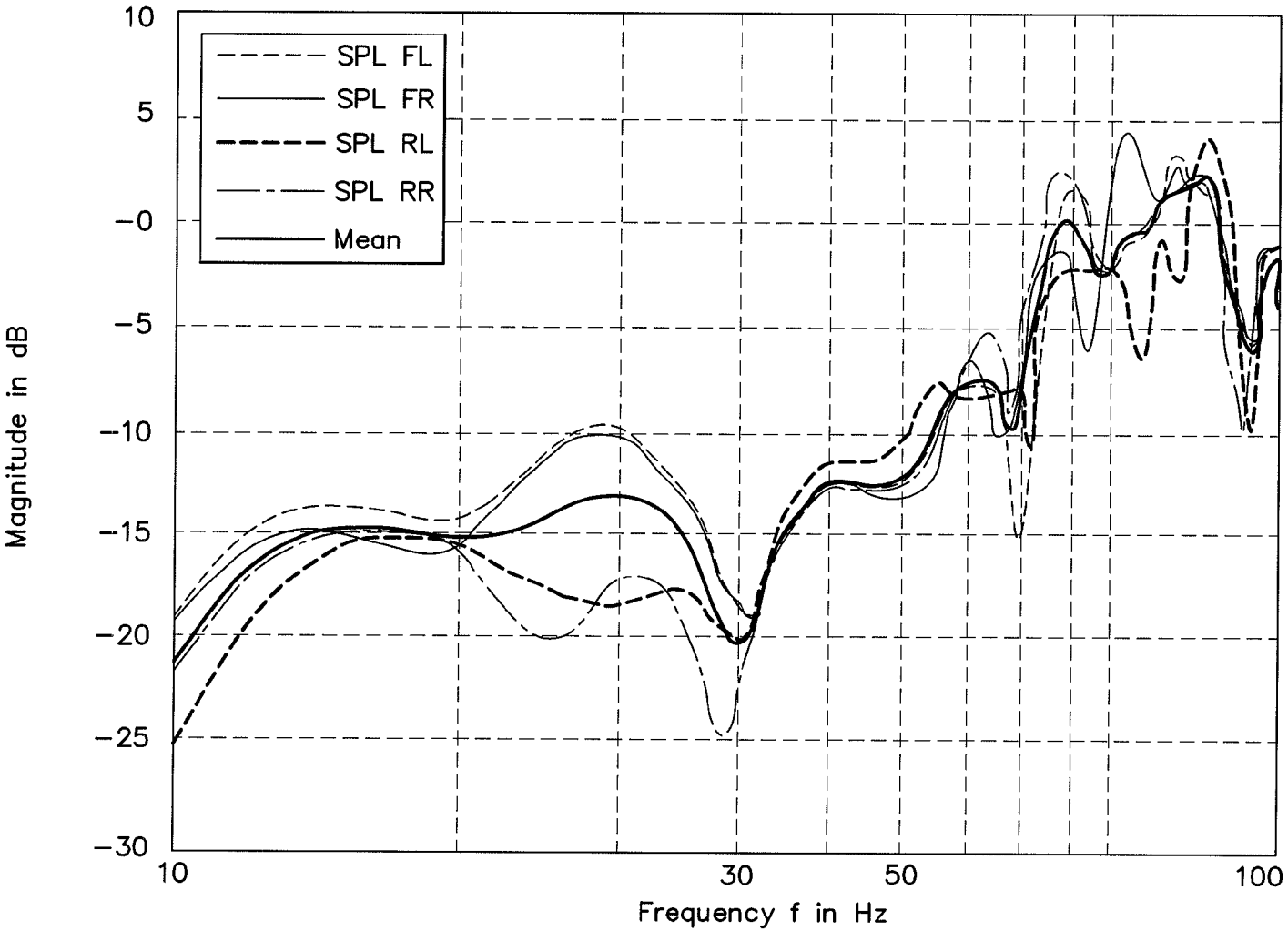

FIG. 12C illustrates the sound pressure levels $SPL_{FL}$, $SPL_{FR}$, $SPL_{RL}$, $SPL_{RR}$ measured at the four listening locations after equalization using the slope-limited phase function of FIG. 11. It is noteworthy that the equalization performs almost as good as the equalization using the phase function of FIG. 10. As a result, the limitation of the phase change to approximately 10°/Hz is regarded as a useful measure that facilitates the design of a FIR filter for approximating the phase function $\phi_{OPT}(f)$.

Figure 12D:
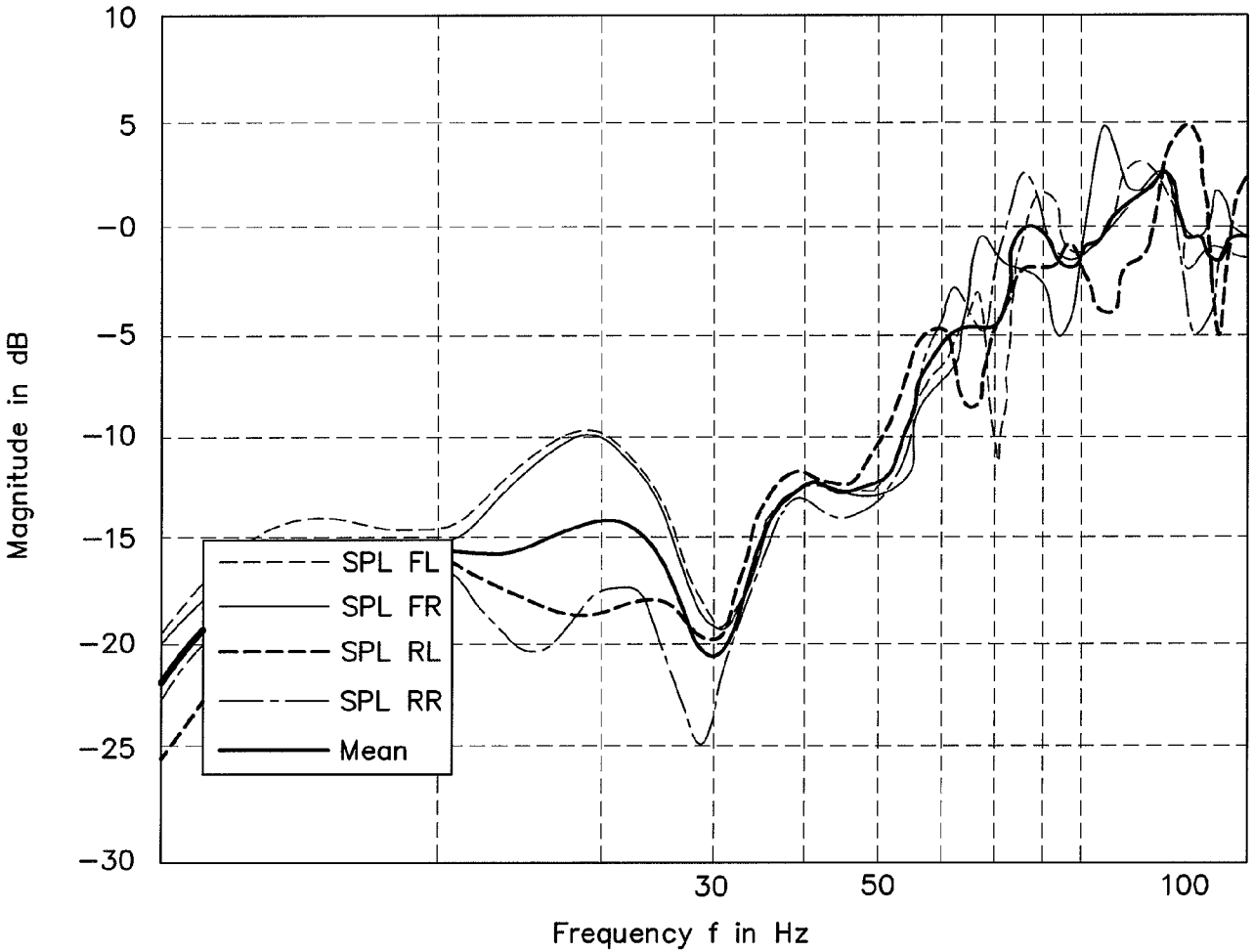

FIG. 12D illustrates the sound pressure levels $SPL_{FL}$, $SPL_{FR}$, $SPL_{RL}$, $SPL_{RR}$ measured at the four listening locations after equalization using a 4096 tap FIR all-pass filter for providing the necessary phase shift to the audio signal supplied to the second loudspeaker. The phase response of the FIR filter is depicted in the diagram of FIG. 11. The result is also satisfactory. The large discrepancies occurring in the unequalized system are avoided and acoustics of the room is substantially improved.

In the examples presented above, a system comprising only two loudspeakers and four listening locations of interest has been assumed. In such a system only one optimal phase function has to be determined and the corresponding FIR filter implemented in the channel supplying one of the loudspeakers (referred to as second loudspeaker in the above examples). In a system with more than two loudspeakers, an additional phase function has to be determined and a corresponding FIR all-pass filter has to be implemented in the channel supplying each additional loudspeaker. If more than four listening locations are of interest, all of them have to be considered in the respective cost function. The general procedure may be summarized as follows:

(A) Assign a number 1, 2, . . . , L to each one of L loudspeakers.

(B) Supply an audio signal of a programmable frequency f to each loudspeaker. The loudspeakers 1 to L receive the respective audio signal from a signal source which has one output channel per loudspeaker connected thereto. At least the channels supplying loudspeakers 2 to L comprising a phase shifter for modifying the phase $\phi_2$, $\phi_3$, . . . , $\phi_L$ of the respective audio signal (phase $\phi_1$ may be zero or constant).

(C) Measure the sound pressure level $SPL_1(\phi_2, f)$, $SPL_2(\phi_2, f)$, . . . $SPL_P(\phi_2, f)$ at each of the P listening location for different phase shifts $\phi_2$ of the audio signal supplied to loudspeaker 2 within a certain phase range (e.g., 0 to 360°) and for different frequencies f within a certain frequency range (e.g., 0 Hz to 150 Hz), the phase shift of the subsequent loudspeakers 3 to L thereby being fixed and initially zero or constant.

(D) Calculate the value of a cost function $CF(\phi_2, f)$ $SPL(\phi_2, f)$, $SPL_2(\phi_2, f)$, $SPL_P(\phi_2, f)$.

(E) Search, for every frequency value f for which the cost function $CF(\phi_2, f)$ has been calculated, for the optimal phase shift $\phi_{OPT2}$ which minimizes (EQs. 2 to 4) the cost function $CF(\phi_2, f)$, thereby obtaining a phase function $\phi_{OPT2}(f)$ representing the optimal phase shift $\phi_{OPT2}$ as a function of frequency.

(F) During the further equalization process (and thereafter), operate the loudspeaker 2 with a filter disposed in the channel supplying the loudspeaker 2, i.e., the loudspeaker 2 is supplied via the filter. The filter at least approximately (FIG. 11) realizes the phase function $\phi_{OPT2}(f)$ and applies a respective frequency dependent optimal phase shift $\phi_{OPT2}(f)$ to the audio signal fed to the loudspeaker 2.

(G) Repeat steps B to F for each subsequent loudspeaker i=3, . . . , L. That is: supply an audio signal to each loudspeaker; measure the sound pressure level $SPL_1(\phi_i, f)$, $SPL_2(\phi_i, f)$, . . . $SPL_P(\phi_i, f)$; calculate the value of a cost function $CF(\phi_i, f)$; search for the optimal phase shift $\phi_{OPTi}(f)$; and henceforth operate loudspeaker i with a filter (approximately) realizing the optimal phase shift $\phi_{OPTi}(f)$.

From FIGS. 12B-D one can see that a substantial difference in sound pressure levels may not be equalized in a frequency range from about 20 to 30 Hz. This is due to the fact that only one loudspeaker (e.g., the subwoofer) of the sound system under test is able to reproduce sound with frequencies below 30 Hz. Consequently, in this frequency range the other loudspeakers were not able to radiate sound and therefore may not be used for equalizing. If a second subwoofer is employed, then this gap in the SPL curves may be "closed".

After equalizing all the loudspeakers as explained above, an additional frequency-dependent gain may be applied to all the channels in order to achieve a desired magnitude response of the sound pressure levels at the listening locations of interest. This frequency-dependent gain is the same for all channels.

The above-described examples relate to equalizing sound pressure levels in at least two listening locations to balance the sound pressure. However, the technique may also be usefully employed even when "balancing" is the not goal of optimization but rather a maximization of sound pressure at the listening locations and/or the adjusting of actual sound pressure curves (SPL over frequency) to match a "target function". In this case the cost function has to be chosen accordingly. If only the maximization of sound pressure or the adjusting of the SPL curve(s) in order to match a target function is to be achieved, this can also be done for only one listening location. In contrast, at least two listening locations have to be considered when a balancing is desired.

For a maximization of sound pressure level the cost function is dependent from the sound pressure level at the considered listening location. In this case the cost function has to be maximized in order to maximize the sound pressure level at the considered listening location(s). Thus the SPL output of an audio system may be improved in the bass frequency range without increasing the electrical power output of the respective audio amplifiers.

After having equalized the sound pressure levels to match the desired target function, the bass management system may be employed in an ANC system as described with reference to FIGS. 4A to 4C. Due to the phase filters of the bass management system disposed upstream to each loudspeaker the "effective" secondary path transfer function S(z) is actively "formed" to match the desired target function. Thus the variations of the magnitude response of the secondary path transfer function S(z) can be substantially improved which entails an improved performance of the FXLMS algorithm used for calculating the filter coefficients of the adaptive filter in the active noise control system.

In the following paragraphs some aspects of the above-described active noise system are summarized. However, the summary is not exhaustive.

One example of the inventive ANC system reduces, at a listening position, the power of a noise signal being radiated from a noise source to a listening position. As illustrated in FIGS. 4A-4C the system comprises an adaptive filter 22 receiving a reference signal $x_e[n]$ that represents the actual noise signal x[n] at the position of the noise source 31 and that provides an output for providing a compensation signal y[n]. The noise signal at the listening position is denoted as d[n]. The compensation signal y[n] is a filtered version of the reference signal x[n] that is adaptively filtered such that the compensation signal y[n] at least partially compensates for the noise signal d[n] at the listening position. The ANC system further comprises at least two acoustic actuators 210, 211 radiating the compensation signal or a filtered version thereof to the listening position. The filtering of the compensation signal y[n] may be done by a bass management system 30 arranged upstream of the acoustic transducers 210, 211. The bass management system distributes the compensation signal y[n] to the acoustic actuators 210, 211 and comprises at least one phase filter that is configured to impose a phase shift $\phi$ to the compensation signal y[k] supplied to at least one of the acoustic actuators, such that the transfer characteristic from the input of the bass management system to the listening position approximately matches a desired transfer function. This transfer characteristic is also called "secondary path" transfer function.

The ANC system also includes a microphone 33 arranged at the listening position, the microphone 33 providing an error signal e[n] that represents the residual noise level at the listening position which ideally is zero. The reference signal x[n] which represents the noise signal at the position of the noise source 31 may be measured by the adequate sensor 32, for example a microphone or a non-acoustical sensor such as a vibration sensor or a rotation sensor. The sensor 32 may be arranged adjacent to the noise source and by employed in feed-forward ANC systems. In feedback ANC systems the reference signal x[n] is calculated from the error signal e[n] and the compensation signal y[n], where the compensation signal y[n] is pre-filtered with an estimated secondary path transfer function S'(z) before being summed to the error signal. The sum signal is an estimated reference signal $x_e[n]$. The adaptation is performed by an LMS algorithm as already described above.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims. Furthermore the scope of the invention is not limited to automotive applications but may also be applied in any other environment, for example, in consumer applications like home cinema or the like and also in cinema and concert halls or the like.

What is claimed is:

1. An active noise cancellation system for reducing, at a listening position, the power of a noise signal being radiated from a noise source to the listening position, the system comprising:

an adaptive filter that receives a reference signal representing the noise signal, and provides a compensation signal;

a bass management unit comprising an all-pass filter that receives the compensation signal and applies a variable phase shift as a function of frequency to the compensation signal to provide a phase shifted compensation signal;

a first acoustic radiator that receives the phase shifted compensation signal and radiates audio indicative thereof to the listening position; and a second acoustic radiator that receives the compensation signal and radiates audio indicative thereof to the listening position;

where transfer function characteristics from the input of the bass management system to the listening position approximately matches a desired transfer function.

2. The system of claim 1, further comprising a microphone arranged at the listening position, and provides an error signal.

3. The system of claim 2, further comprising a sensor configured to provide the reference signal which represents the noise signal.

4. The system of claim 2, further comprising means responsive to the error signal and the compensation signal, for calculating the reference signal.

5. The system of claim 2, further comprising an adaptation unit that calculates filter coefficients for the adaptive filter in response to the error signal and the reference signal.

6. The system of claim 5, further comprising a filter unit receiving the reference signal and providing a filtered reference signal to the adaptation unit, the transfer behavior being characterized by a transfer function being an a-priori estimation of the transfer characteristic from the input of the bass management system to the listening position.

7. The system of claim 6, where the adaptation unit uses a Filtered-x LMS algorithm or a Filtered-e LMS algorithm for calculating the filter coefficients.

8. The system of claim 7, where the sensor is a non-acoustic sensor.

9. The system of claim 1, where the bass management system comprises a channel for each acoustic actuator that provides the compensation signal to the respective acoustic actuator, where at least each but one channel comprises a phase filter.

10. A method for reducing, at a listening position, the power of a noise signal being radiated from a noise source to the listening position, the method comprising:

providing a reference signal representing the noise signal;

adaptive filtering the reference signal to provide a compensation signal;

supplying the compensation signal to at least two acoustic transducers via a bass management system for radiating the compensation signal or filtered versions thereof, where the bass management system distributes the compensation signal to the acoustic transducers and filters the compensation signal for at least a first acoustic transducer by an all-pass filter that applies a variable phase shift as a function of frequency such that the transfer characteristic from the input of the bass management system to the listening position approximately matches a desired transfer function.

11. The method of claim 10, further comprising measuring an error signal at the listening position.

12. The method of claim 11, further comprising measuring the reference signal representing the noise signal by a sensor that is configured to provide the reference signal representing the noise signal.

13. The method of claim 11, further comprising means for calculating the reference signal from the error signal and the compensation signal.

14. The method of claim 11, further comprising calculating filter coefficients for the adaptive filter dependent from the error and from the reference signal.

15. The method of claim 14, further comprising filtering the reference signal with a given transfer function before calculating therefrom the filter coefficients for the adaptive filter, the transfer function being an a-priori estimation of the transfer characteristic from the input of the bass management system to the listening position.

16. The method of claim 15, where the filter coefficients for the adaptive filter are calculated using a Filtered-x LMS algorithm or a Filtered-e LMS algorithm.

17. The system of claim 1, wherein the all-pass filter comprises a FIR filter.

18. The method of claim 10, wherein the all-pass filter comprises a FIR filter.

* * * * *